US007772525B2

(12) United States Patent
Annavarapu et al.

(10) Patent No.: US 7,772,525 B2
(45) Date of Patent: Aug. 10, 2010

(54) CERAMIC IGNITERS

(75) Inventors: Suresh Annavarapu, Somerville, MA (US); Helge Zimmet, Waltham, MA (US)

(73) Assignee: Saint-Gobain Ceramics & Plastics, Inc., Worcester, MA (US)

( * ) Notice: Subject to any disclaimer, the term of this patent is extended or adjusted under 35 U.S.C. 154(b) by 561 days.

(21) Appl. No.: 11/346,987

(22) Filed: Feb. 3, 2006

(65) Prior Publication Data

US 2006/0213897 A1 Sep. 28, 2006

Related U.S. Application Data

(60) Provisional application No. 60/650,353, filed on Feb. 5, 2005.

(51) Int. Cl.
*F23Q 7/00* (2006.01)
*F23Q 7/22* (2006.01)

(52) U.S. Cl. ..... 219/260; 219/270

(58) Field of Classification Search ..... 219/270, 219/260, 261, 262, 263, 264, 265, 266, 267, 219/268, 269
See application file for complete search history.

(56) References Cited

U.S. PATENT DOCUMENTS

| | | | | |
|---|---|---|---|---|
| 4,931,619 | A | 6/1990 | Ogata et al. | |
| 5,130,055 | A | 7/1992 | Yasutomi et al. | |
| 6,274,079 | B1 | 8/2001 | Lindemann et al. | |
| 6,309,589 | B1 | 10/2001 | Knoll et al. | |
| 6,483,079 | B2 * | 11/2002 | Sato et al. | 219/270 |
| 6,646,231 | B2 * | 11/2003 | Hotta et al. | 219/270 |
| 6,933,471 | B2 * | 8/2005 | Hamel et al. | 219/270 |
| 2002/0150851 | A1 * | 10/2002 | Willkens | 431/25 |
| 2002/0190048 | A1 * | 12/2002 | McPhillips | 219/270 |

* cited by examiner

*Primary Examiner*—Daniel Robinson
(74) *Attorney, Agent, or Firm*—Edwards Angell Palmer & Dodge LLP; Peter F. Corless; Lisa Swiszcz Hazzard

(57) ABSTRACT

New methods are provided for manufacture ceramic resistive igniter elements that include injection molding of one or more layers of the formed element. Ceramic igniters also are provided that are obtainable from fabrication methods of the invention.

15 Claims, 2 Drawing Sheets

CERAMIC IGNITERS

The present application claims the benefit of U.S. provisional application No. 60/650,353, filed Feb. 5, 2005, which is incorporated herein by reference in its entirety.

BACKGROUND

1. Field of the Invention

In one aspect, the invention provides new methods for manufacture ceramic resistive igniter elements that include injection molding of one or more regions of the formed element. Igniter elements also are provided obtainable from fabrication methods of the invention are provided.

2. Background

Ceramic materials have enjoyed great success as igniters in e.g. gas-fired furnaces, stoves and clothes dryers. Ceramic igniter production includes constructing an electrical circuit through a ceramic component a portion of which is highly resistive and rises in temperature when electrified by a wire lead. See, for instance, U.S. Pat. Nos. 6,582,629; 6,278,087; 6,028,292; 5,801,361; 5,786,565; 5,405,237; and 5,191,508.

Typical igniters have been generally rectangular-shaped elements with a highly resistive "hot zone" at the igniter tip with one or more conductive "cold zones" providing to the hot zone from the opposing igniter end. One currently available igniter, the Mini-Igniter™, available from Norton Igniter Products of Milford, N.H., is designed for 12 volt through 120 volt applications and has a composition comprising aluminum nitride ("AlN"), molybdenum disilicide ("$MoSi_2$"), and silicon carbide ("SiC").

Igniter fabrication methods have included batch-type processing where a die is loaded with ceramic compositions of at least two different resistivities. The formed green element is then densified (sintered) at elevated temperature and pressure. See the above-mentioned patents. See also U.S. Pat. No. 6,184,497.

While such fabrication methods can be effective to produce ceramic igniters, batch-type processing presents inherent limitations with respect to output and cost efficiencies.

Current ceramic igniters also have suffered from breakage during use, particularly in environments where impacts may be sustained such as igniters used for gas cooktops and the like.

It thus would be desirable to have new ignition systems. It would be particularly desirable to have new methods for producing ceramic resistive elements. It also would be desirable to have new igniters that have good mechanical integrity.

SUMMARY OF THE INVENTION

New methods for producing ceramic igniter elements are now provided which include injection molding of ceramic material to thereby form the ceramic element. Such injection molding fabrication can provide enhanced output and cost efficiencies relative to prior approaches such as die cast methods as well as provide igniters of notable mechanical strength.

More particularly, preferred methods of the invention include injection molding of one or more layers to form a ceramic element. If multiple layers of a single element are injection molded, preferably those layers have differing resistivities to provide regions of distinct conductivity in the formed element. For example, an element may be formed by injection molding of one or more multiple, sequential regions of 1) an optional insulator (heat sink); 2) conductive zone; 3) resistive hot zone; and 4) second conductive zone.

In preferred aspects of the invention, at least three portions of an igniter element are injection molded in single fabrication sequence to produce a ceramic component, a so-called "multiple shot" injection molding process where in the same fabrication sequence where multiple portions of an igniter element having different resistivity values (e.g. hot or highly resistive portion, cold or conductive portion, and insulator or heat sink portion). In at least certain embodiments, a single fabrication sequence includes sequential injection molding applications of a ceramic material without removal of the element from the element-forming area and/or without deposition of ceramic material to an element member by a process other than injection molding.

For instance, in one aspect, a first insulator (heat sink) portion can be injection molded, around that insulator portion conductive leg portions then can be injection molded in a second step, and in a third step a resistive hot or ignition zone can be applied by injection molding to the body containing insulator and resistive zones.

For injection molding three or more portions of an igniter element (i.e. so-called three-shot or higher injection molding process), good mating of the third (or further subsequent) injection molded portion with previously deposited first and second portions can be important to ensure that a uniform and effective element is produced. That is, desired performance results of the produced igniter can be further ensured by accurate placement of the third or further injection molded portion of the igniter element with respect to previously deposited igniter portions.

Such good mating of the third or further injection-molded portions of the igniter element can be facilitated by effective air removal from the site where the ceramic material is being deposited via injection molding. For example, effective venting (removal) of air from the deposition site can aid good mating of the ceramic material being deposited with previously deposited ceramic igniter portions. Such venting can be accomplished by various methods, including maintaining a slight negative pressure (vacuum line) in the general area that ceramic material is being deposited.

In another embodiment, methods for producing a resistive igniter are provided, which include injection molding one or more portions of a ceramic element, wherein the ceramic element comprises three or more regions of differing resistivity. In preferred aspects, an igniter region (first region) may be considered as differing in resisitivity from another igniter region (second region) if the first and second regions have a difference in room temperature resisitivity of least 10 or $10^2$ ohms-cm, or more suitably a difference in room temperature resisitivity of least $10^3$ or $10^4$ ohms-cm.

Thus, fabrication methods of the invention may include additional processes for addition of ceramic material to produce the formed ceramic element. For instance, one or more ceramic layers may be applied to a formed element such as by dip coating, spray coating and the like of a ceramic composition slurry.

Preferred ceramic elements obtainable by methods of the invention comprise a first conductive zone, a resistive hot zone, and a second conductive zone, all in electrical sequence. Preferably, during use of the device electrical power can be applied to the first or the second conductive zones through use of an electrical lead (but typically riot both conductive zones).

Particularly preferred igniters of the invention of the invention will have a rounded cross-sectional shape along at least a portion of the igniter length (e.g., the length extending from where an electrical lead is affixed to the igniter to a resistive hot zone). More particularly, preferred igniters may have a substantially oval, circular or other rounded cross-sectional shape for at least a portion of the igniter length, e.g. at least about 10 percent, 40 percent, 60 percent, 80 percent, 90 percent of the igniter length, or the entire igniter length. Such rod configurations offer higher Section Moduli and hence can enhance the mechanical integrity of the igniter.

Ceramic igniters of the invention can be employed at a wide variety of nominal voltages, including nominal voltages of 6, 8, 10, 12, 24, 120, 220, 230 and 240 volts.

The igniters of the invention are useful for ignition in a variety of devices and heating systems. More particularly, heating systems are provided that comprise a sintered ceramic igniter element as described herein. Specific heating systems include gas cooking units, heating units for commercial and residential buildings, including water heaters.

Other aspects of the invention are disclosed infra.

DETAILED DESCRIPTION OF THE INVENTION

Figure 1A:
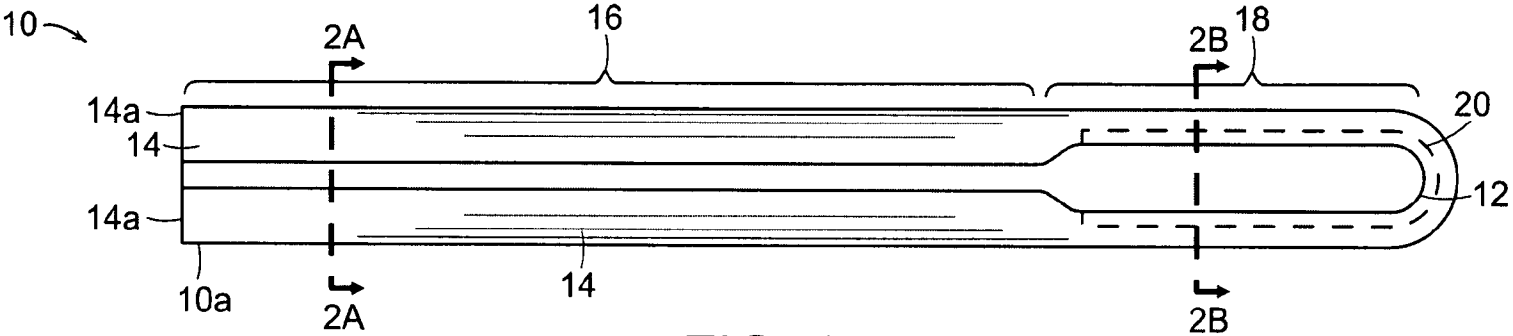
FIGS. 1A and 1B show top and bottom views respectively of an igniter of the invention.

As discussed above, new methods are now provided for producing ceramic igniter elements that include injection molding of one or more layers or regions of the element.

As typically referred to herein, the term "injection molded," "injection molding" or other similar term indicates the general process where a material (here a ceramic or pre-ceramic material) is injected or otherwise advanced typically under pressure into a mold in the desired shape of the ceramic element followed by cooling and subsequent removal of the solidified element that retains a replica of the mold.

In injection molding formation of igniter elements of the invention, a ceramic material (such as a ceramic powder mixture, dispersion or other formulation) or a pre-ceramic material or composition may be advanced into a mold element.

In suitable fabrication methods of the invention, an integral igniter element having regions of differing resistivities (e.g., conductive region(s), insulator or heat sink region and higher resistive "hot" zone(s)) may be formed by sequential injection molding of ceramic or pre-ceramic materials having differing resisitivities.

Thus, for instance, a base element may be formed by injection introduction of a ceramic material having a first resisitivity (e.g. ceramic material that can function as an insulator or heat sink region) into a mold element that defines a desired base shape such as a rod shape. The base element may be removed from such first mold and positioned in a second, distinct mold element and ceramic material having differing resistivity—e.g. a conductive ceramic material—can be injected into the second mold to provide conductive region(s) of the igniter element. In similar fashion, the base element may be removed from such second mold and positioned in a yet third, distinct mold element and ceramic material having differing resistivity—e.g. a resistive hot zone ceramic material—can be injected into the third mold to provide resistive hot or ignition region(s) of the igniter element.

Alternatively, rather than such use of a plurality of distinct mold elements, ceramic materials of differing resitivities may be sequentially advanced or injected into the same mold element. For instance, a predetermined volume of a first ceramic material (e.g. ceramic material that can function as an insulator or heat sink region) may be introduced into a mold element that defines a desired base shape and thereafter a second ceramic material of differing resisitivity may be applied to the formed base.

Ceramic material may be advanced (injected) into a mold element as a fluid formulation that comprises one or more ceramic materials such as one or more ceramic powders.

For instance, a slurry or paste-like composition of ceramic powders may be prepared, such as a paste provided by admixing one or more ceramic powders with an aqueous solution or an aqueous solution that contains one or more miscible organic solvents such as alcohols and the like. A preferred ceramic slurry composition for extrusion may be prepared by admixing one or more ceramic powders such as $MoSi_2$, SiC, $Al_2O_3$, and/or AlN in a fluid composition of water optionally together with one or more organic solvents such as one or more aqueous-miscible organic solvents such as a cellulose ether solvent, an alcohol, and the like. The ceramic slurry also may contain other materials e.g. one or more organic plasticizer compounds optionally together with one or more polymeric binders.

A wide variety of shape-forming or inducing elements may be employed to form an igniter element, with the element of a configuration corresponding to desired shape of the formed igniter. For instance, to form a rod-shaped element, a ceramic powder paste may be injected into a cylindrical die element. To form a stilt-like or rectangular-shaped igniter element, a rectangular die may be employed.

After advancing ceramic material(s) into a mold element, the defined ceramic part suitably may be dried e.g. in excess of 50° C. or 60° C. for a time sufficient to remove any solvent (aqueous and/or organic) carrier.

The examples which follow describe preferred injection molding processes to form an igniter element.

Figure 1B:
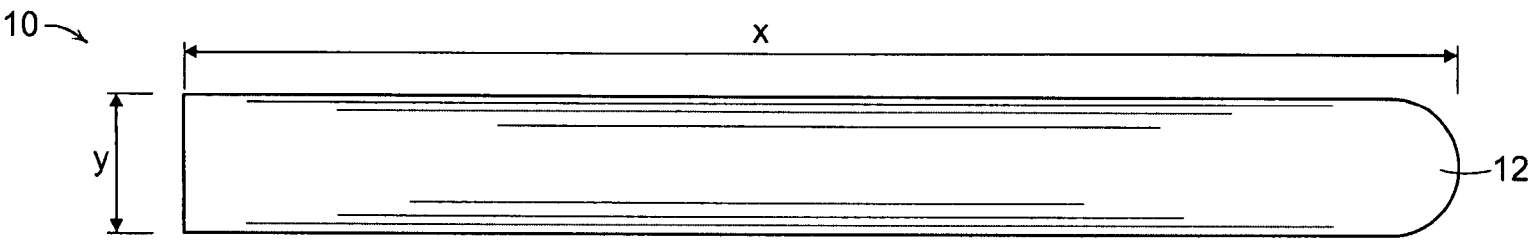

Referring now to the drawings, FIGS. 1A and 1B shows a suitable igniter element 10 of the invention that has been produced through injection molding of regions of differing resisitivities.

As can be seen in FIG. 1A, igniter 10 includes a central heat sink or insulator region 12 which is encased within region(s) of differing resistivity, namely conductive zones 14 in the proximal portion 16 which become more resistive where in igniter proximal portion 18 the region has a comparatively decreased volume and thus can function as resistive hot zone 20.

FIG. 1B shows igniter bottom face with exposed heat sink region 12.

Figure 2B:
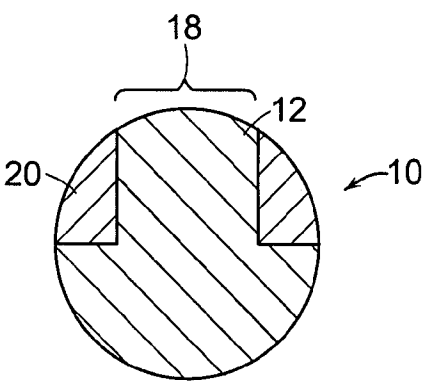
FIG. 2B shows a cut-away view along line 2B-2B of FIG. 1A.
Figure 2A:
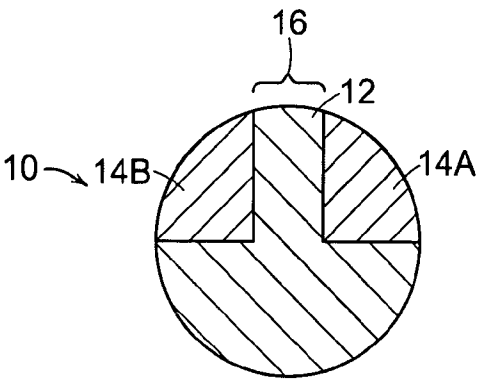
FIG. 2A shows a cut-away view along line 2A-2A of FIG. 1A.

Cross-sectional views of FIGS. 2A and 2B further depict igniter 10 which includes conductive zones 14A and 14B in igniter proximal region 16 and corresponding resistive hot zone 20 in igniter distal zone 18.

In use, power can be supplied to igniter 10 (e.g. via one or more electrical leads, not shown) into conductive zone 14A which provides an electrical path through resistive ignition zone 20 and then through conductive zone 14B. Proximal ends 14*a* of conductive regions 14 may be suitably affixed such as through brazing to an electrical lead (not shown) that supplies power to the igniter during use. The igniter proximal end 10*a* suitably may be mounted within a variety of fixtures, such as where a ceramoplastic sealant material encases conductive element proximal end 14*a* as disclosed in U.S. Published Patent Application 2003/0080103. Metallic fixtures also maybe suitably employed to encase the igniter proximal end.

Figure 3A:
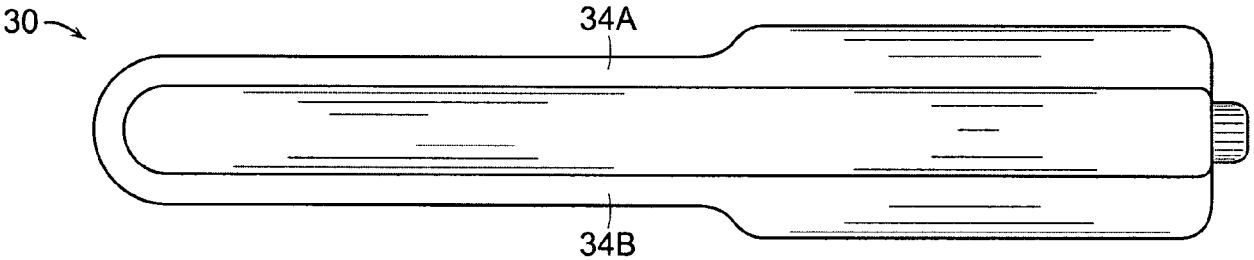
FIGS. 3A and 3B show top and side views respectively of another preferred igniter of the invention.
Figure 3B:
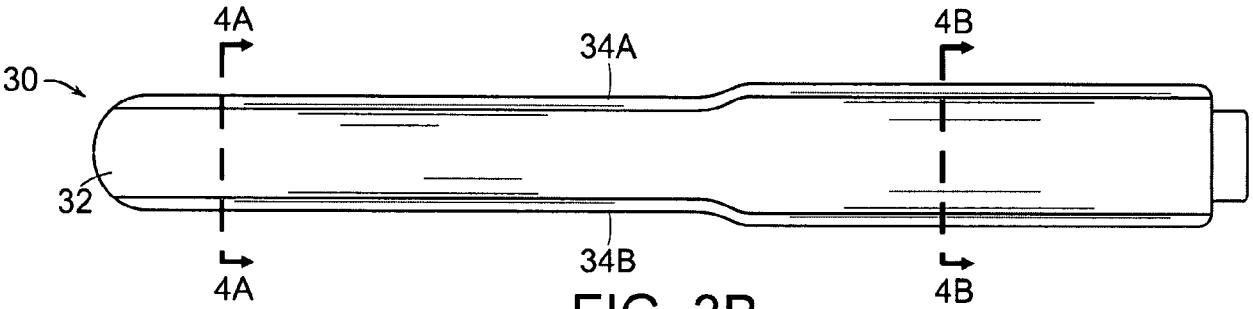
Figure 4B:
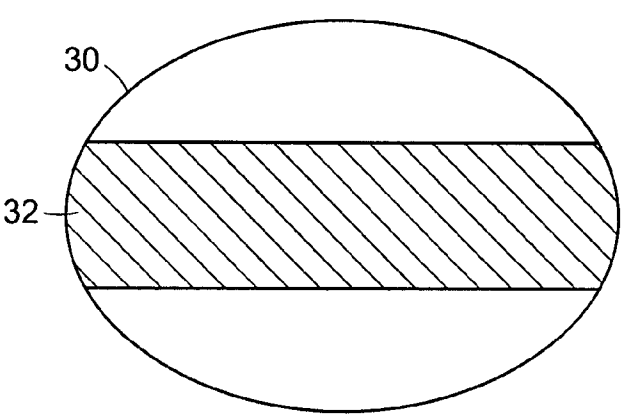
FIG. 4B shows a cut-away view along line 4B-4B of FIG. 3B.
Figure 4A:
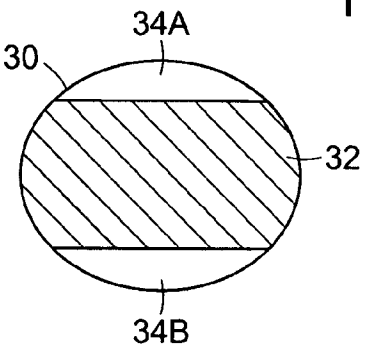
FIG. 4A shows a cut-away view along line 4A-4A of FIG. 3B.

FIG. 3A shows a top view of another preferred igniter 30 of the invention that includes a central igniter body portion 32 that includes conductive zones 34A and 34B. FIG. 3B shows a side view of that igniter 30. FIGS. 4A and 4B depict respective cross-sectional views of the igniter 30 of FIG. 3B.

The igniter element 10 formed by such injection molding processing may be further processed as desired. For example, the formed igniter 10 also may be further densified such as under conditions that include temperature and pressure.

Additionally, igniter regions of differing resisitivity may be applied to an igniter base element by procedures other than dip coating, e.g. an igniter element may be dip coated in a ceramic composition slurry to provide an igniter region with appropriate masking of non-coated igniter regions. For such dip coating applications, a slurry or other fluid-like composition of the ceramic composition may be suitably employed. The slurry may comprise water and/or polar organic solvent carriers such as alcohols and the like and one or more additives to facilitate the formation of a uniform layer of the applied ceramic composition. For instance, the slurry composition may comprise one or more organic emulsifiers, plasticizers, and dispersants. Those binder materials may be suitably removed thermally during subsequent densification of the igniter element.

As discussed above, and exemplified by igniter 10 of FIGS. 1A, 1B, 2A and 2B, at least a substantial portion of the igniter length has a rounded cross-sectional shape along at least a portion of the igniter length, such as length x shown in FIG. 1B. Igniter 10 of FIGS. 1A, 1B, 2A and 2B depicts a particularly preferred configuration where igniter 10 has a substantially circular cross-sectional shape for about the entire length of the igniter to provide a rod-shaped igniter element. However, preferred systems also include those where only a portion of the igniter has a rounded cross-sectional shape, such as where up to about 10, 20, 30, 40, 50, 60, 70 80 or 90 of the igniter length (as exemplified by igniter length x in FIG. 1B) has a rounded cross-sectional shape; in such designs, the balance of the igniter length may have a profile with exterior edges.

Significantly, methods of the invention can facilitate fabrication of igniters of a variety of configurations as may be desired for a particular application. To provide a particular configuration, an appropriate shape-inducing mold element is employed through which a ceramic composition (such as a ceramic paste) may be injected.

Dimensions of igniters of the invention may vary widely and may be selected based on intended use of the igniter. For instance, the length of a preferred igniter (length x in FIG. 1B) suitably may be from about 0.5 to about 5 cm, more preferably from about 1 about 3 cm, and the igniter cross-sectional width may suitably be from about (length y in FIG. 1B) suitably may be from about 0.2 to about 3 cm.

Similarly, the lengths of the conductive and hot zone regions also may suitably vary. Preferably, the length of a first conductive zone (length of proximal region 16 in FIG. 1A) of an igniter of the configuration depicted in FIG. 1A may be from 0.2 cm to 2, 3, 4, or 5 more cm. More typical lengths of the first conductive zone will be from about 0.5 to about 5 cm. The total hot zone electrical path length (length f in FIG. 1A) suitably may be about 0.2 to 5 or more cm.

In preferred systems, the hot or resistive zone of an igniter of the invention will heat to a maximum temperature of less than about 1450° C. at nominal voltage; and a maximum temperature of less than about 1550° C. at high-end line voltages that are about 110 percent of nominal voltage; and a maximum temperature of less than about 1350° C. at low-end line voltages that are about 85 percent of nominal voltage.

A variety of compositions may be employed to form an igniter of the invention. Generally preferred hot zone compositions comprise two or more components of 1) conductive material; 2) semiconductive material; and 3) insulating material. Conductive (cold) and insulative (heat sink) regions may be comprised of the same components, but with the components present in differing proportions. Typical conductive materials include e.g. molybdenum disilicide, tungsten disilicide, nitrides such as titanium nitride, and carbides such as titanium carbide. Typical semiconductors include carbides such as silicon carbide (doped and undoped) and boron carbide. Typical insulating materials include metal oxides such as alumina or a nitride such as AlN and/or $Si_3N_4$.

As referred to herein, the term electrically insulating material indicates a material having a room temperature resistivity of at least about $10^{10}$ ohms-cm. The electrically insulating material component of igniters of the invention may be comprised solely or primarily of one or more metal nitrides and/or metal oxides, or alternatively, the insulating component may contain materials in addition to the metal oxide(s) or metal nitride(s). For instance, the insulating material component may additionally contain a nitride such as aluminum nitride (AlN), silicon nitride, or boron nitride; a rare earth oxide (e.g. yttria); or a rare earth oxynitride. A preferred added material of the insulating component is aluminum nitride (AlN).

As referred to herein, a semiconductor ceramic (or "semiconductor") is a ceramic having a room temperature resistivity of between about 10 and $10^8$ ohm-cm. If the semiconductive component is present as more than about 45 v/o of a hot zone composition (when the conductive ceramic is in the range of about 6-10 v/o), the resultant composition becomes too conductive for high voltage applications (due to lack of insulator). Conversely, if the semiconductor material is present as less than about 10 v/o (when the conductive ceramic is in the range of about 6-10 v/o), the resultant composition becomes too resistive (due to too much insulator). Again, at higher levels of conductor, more resistive mixes of the insulator and semiconductor fractions are needed to achieve the desired voltage. Typically, the semiconductor is a carbide from the group consisting of silicon carbide (doped and undoped), and boron carbide. Silicon carbide is generally preferred.

As referred to herein, a conductive material is one which has a room temperature resistivity of less than about $10^{-2}$ ohm-cm. If the conductive component is present in an amount of more than 35 v/o of the hot zone composition, the resultant ceramic of the hot zone composition, the resultant ceramic can become too conductive. Typically, the conductor is selected from the group consisting of molybdenum disilicide, tungsten disilicide, and nitrides such as titanium nitride, and carbides such as titanium carbide. Molybdenum disilicide is generally preferred.

In general, preferred hot (resistive) zone compositions include (a) between about 50 and about 80 v/o of an electrically insulating material having a resistivity of at least about $10^{10}$ ohm-cm; (b) between about 0 (where no semiconductor material employed) and about 45 v/o of a semiconductive material having a resistivity of between about 10 and about $10^8$ ohm-cm; and (c) between about 5 and about 35 v/o of a metallic conductor having a resistivity of less than about $10^{-2}$ ohm-cm. Preferably, the hot zone comprises 50-70 v/o electrically insulating ceramic, 10-45 v/o of the semiconductive ceramic, and 6-16 v/o of the conductive material. A specifically preferred hot zone composition for use in igniters of the invention contains 10 v/o $MoSi_2$, 20 v/o SiC and balance AlN or $Al_2O_3$.

As discussed, igniters of the invention contain a relatively low resistivity cold zone region in electrical connection with the hot (resistive) zone and which allows for attachment of wire leads to the igniter. Preferred cold zone regions include those that are comprised of e.g. AlN and/or $Al_2O_3$ or other insulating material; SiC or other semiconductor material; and $MoSi_2$ or other conductive material. However, cold zone regions will have a significantly higher percentage of the conductive and semiconductive materials (e.g., SiC and $MoSi_2$) than the hot zone. A preferred cold zone composition comprises about 15 to 65 v/o aluminum oxide, aluminum nitride or other insulator material; and about 20 to 70 v/o $MoSi_2$ and SiC or other conductive and semiconductive material in a volume ratio of from about 1:1 to about 1:3. For many applications, more preferably, the cold zone comprises about 15 to 50 v/o AlN and/or $Al_2O_3$, 15 to 30 v/o SiC and 30 to 70 v/o $MoSi_2$. For ease of manufacture, preferably the cold zone composition is formed of the same materials as the hot zone composition, with the relative amounts of semiconductive and conductive materials being greater.

A specifically preferred cold zone composition for use in igniters of the invention contains 20 to 35 v/o $MoSi_2$, 45 to 60 v/o SiC and balance either AlN and/or $Al_2O_3$.

For at least certain applications, igniters of the invention may suitably comprise a non-conductive (insulator or heat sink) region. Such a heat sink region may be employed in a variety of configurations within an igniter element. As discussed above, a preferred configuration provides a heat sink region as a central body region of an igniter element.

Such a heat sink zone may mate with a conductive zone or a hot zone, or both. Preferably, a sintered insulator region has a resistivity of at least about $10^{14}$ ohm-cm at room temperature and a resistivity of at least $10^4$ ohm-cm at operational temperatures and has a strength of at least 150 MPa. Preferably, an insulator region has a resistivity at operational (ignition) temperatures that is at least 2 orders of magnitude greater than the resistivity of the hot zone region. Suitable insulator compositions comprise at least about 90 v/o of one or more aluminum nitride, alumina and boron nitride. A specifically preferred insulator composition of an igniter of the invention consists of 60 v/o AlN; 10 v/o $Al_2O_3$; and balance SiC. Another preferred heat composition for use with an igniter of the invention contains 80 v/o AlN and 20 v/o sic.

The igniters of the present invention may be used in many applications, including gas phase fuel ignition applications such as furnaces and cooking appliances, baseboard heaters, boilers, and stove tops. In particular, an igniter of the invention may be used as an ignition source for stop top gas burners as well as gas furnaces.

Igniters of the invention also are particularly suitable for use for ignition where liquid fuels (e.g. kerosene, gasoline) are evaporated and ignited, e.g. in vehicle (e.g. car) heaters that provide advance heating of the vehicle.

Preferred igniters of the invention are distinct from heating elements known as glow plugs. Among other things, frequently employed glow plugs often heat to relatively lower temperatures e.g. a maximum temperature of about 800° C., 900° C. or 1000° C. and thereby heat a volume of air rather than provide direct ignition of fuel, whereas preferred igniters of the invention can provide maximum higher temperatures such as at least about 1200° C., 1300° C. or 1400° C. to provide direct ignition of fuel. Preferred igniters of the invention also need not include gas-tight sealing around the element or at least a portion thereof to provide a gas combustion chamber, as typically employed with a glow plug system. Still further, many preferred igniters of the invention are useful at relatively high line voltages, e.g. a line voltage in excess of 24 volts, such as 60 volts or more or 120 volts or more including 220, 230 and 240 volts, whereas glow plugs are typically employed only at voltages of from 12 to 24 volts.

The following non-limiting examples are illustrative of the invention. All documents mentioned herein are incorporated herein by reference in their entirety.

Example 1

Igniter Fabrication

Powders of a resistive composition (22 vol % $MoSi_2$, remainder $Al_2O_3$) and an insulating composition (100 vol % $Al_2O_3$) were mixed with an organic bonder (about 6-8 wt % vegetable shortening, 2.4 wt % polystyrene and 2-4 wt % polyethylene) to form two pastes with about 62 vol % solids. The two pastes were loaded into two barrels of a co-injection molder. A first shot filled a half-cylinder shaped cavity with insulating paste forming the supporting base with a fin running along the length of the cylinder. The part was removed from the first cavity, placed in a second cavity and a second shot filled the volume bounded by the first shot and the cavity wall core with the conductive paste. The molded part which forms a hair-pin shaped conductor with insulator separating the two legs. The rod was then partially debindered at room temperature in an organic solvent dissolving out 10 wt % of the added 10-16 wt %. The part was then thermally debindered in flowing inert gas ($N_2$) at 300-500° C. for 60 hours to remove the remainder of the residual binder. The debindered part was densified to 95-97% of theoretical at 1800-1850° C. in Argon. The densified part was cleaned up by grit-blasting. When the two legs of the igniter are connected to a power supply at a voltage of 36V, the hot-zone attained at temperature of about 1300° C.

Example 2

Additional Igniter Fabrication

Powders of a resistive composition (22 vol % $MoSi_2$, remainder $Al_2O_3$) and an insulating composition (5 vol % SiC, remainder $Al_2O_3$) were mixed with an organic bonder (about 6-8 wt % vegetable shortening, 2.4 wt % polystyrene and 2-4 wt % polyethylene) to form two pastes with about 62 vol % solids. The two pastes were loaded into two barrels of a co-injection molder. A first shot filled a half-cylinder shaped cavity with insulating paste forming the supporting base with a fin running along the length of the cylinder. The part was removed from the first cavity, placed in a second cavity and a second shot filled the volume bounded by the first shot and the cavity wall core with the conductive paste. The molded part which forms a hair-pin shaped conductor with insulator separating the two legs. The rod was then partially debindered at room temperature in an organic solvent dissolving out 10 wt % of the added 10-16 wt %. The part was then thermally debindered in flowing inert gas such as $N_2$ at 300-500° C. for 60 hours to remove the remainder of the residual binder. The debindered parts were densified to 95-97% of theoretical at 1800-1850° C. in Argon. Densified parts were cleaned up by grit-blasting. When the two legs of the igniters are connected to a power supply at voltages ranging from of 120V, the hot-zone attained at temperature of about 1307° C.

Example 3

Additional Igniter Fabrication

Powders of a resistive composition (22 vol % $MoSi_2$, 20 vol % SiC, remainder $Al_2O_3$) and an insulating composition (20 vol % SiC, remainder $Al_2O_3$) were mixed with about 15 wt % polyvinyl alcohol to form two pastes with about 60 vol % solids. The two pastes were loaded into two barrels of a co-injection molder. A first shot filled a cavity that had an hour-glass shaped cross-section with insulating paste forming the supporting base. The part was removed from the first cavity, placed in a second cavity and a second shot filled the volume bounded by the first shot and the cavity wall core with the conductive paste. The molded part which forms a hair-pin shaped conductor with insulator separating the two legs was then partially debindered in tap water dissolving out 10 wt % of the added 10-16 wt %. The part was then thermally debindered in flowing inert gas ($N_2$) at 500° C. for 24 h to remove the remainder of the residual binder. The debindered part was densified to 95-97% of theoretical at 1800-1850° C. in Argon. The densified part was cleaned up by grit-blasting. When the two legs of the igniter are connected to a power supply at a voltage of 48V, the hot-zone attained at temperature of about 1300° C.

Example 4

Further Igniter Fabrication

Powders of a resistive composition (20 vol % $MoSi_2$, 5 vol % SiC, 74 vol % $Al_2O_3$ and 1 vol % $Gd_2O_3$), a conductive composition (28 vol % $MoSi_2$, 7 vol % SiC, 64 vol % $Al_2O_3$ and 1 vol % $Gd_2O_3$) and an insulating composition (10 vol % $MoSi_2$, 89 vol % $Al_2O_3$ and 1 vol % $Gd_2O_3$) were mixed with 10-16 wt % organic binder (about 6-8 wt % vegetable shortening, 24 wt % polystyrene and 2-4 wt % polyethylene) to form three pastes with about 62-64 vol % solids loading. The three pastes were loaded into the barrels of a co-injection molder. A first shot filled a cavity that had an hour-glass shaped cross-section with the insulating paste forming the supporting base. The part was removed from the first cavity and placed in a second cavity. A second shot filled the bottom half of the volume bounded by the first shot and the cavity wall with the conductive paste. The part was removed from the second cavity and placed in a third cavity. A third shot filled the volume bounded by the first shot, second shot and the cavity wall with resistive paste forming a hair-pin shaped resistor separated by the insulator and connected to conductive legs also separated by the insulator. The molded part was the partially debindered in n-propyl bromide dissolving out 10 wt % of the added 10-16 wt %. The part was then thermally debindered in slowing Ar or $N_2$ at 500° C. for 24 h to remove the remaining binder and densified to 95-97% of theoretical at 1750° C. in Argon at 1 atm pressure. When the two conductive legs of the igniter are connected to a power supply of a voltage of 120V, the hot-zone (i.e. the resistive zone) attained a temperature of 1300° C.

The invention has been described in detail with reference to particular embodiments thereof. However, it will be appreciated that those skilled in the art, upon consideration of this disclosure, may make modification and improvements within the spirit and scope of the invention.

What is claimed is:

1. A method for producing a resistive igniter, comprising,
(a) injection molding a first region comprising a first material having a first resistivity;
(b) subsequently injection molding a second region, the second region being in connection with the first region, the second region comprising a second material having a second resistivity different than the first resistivity; and
(c) subsequently injection molding a third region, the third region being in connection with at least one of the first and/or second regions, the third region comprising a third material having a third resistivity different than the first and second resistivity,
to thereby form a ceramic element.

2. The method of claim 1 wherein the ceramic element comprises regions of differing resistivity through a cross-section of the element.

3. The method of claim 1 further comprising applying one or more ceramic compositions to at least a portion of the ceramic element.

4. The method of claim 3 wherein a conductive ceramic composition is applied to the ceramic element.

5. The method of claim 3 wherein at least two distinct ceramic compositions having differing resistivities are applied to the ceramic element.

6. The method of claim 1 further comprising densifying the formed ceramic element.

7. The method of claim 1 wherein a portion of the igniter interior is removed.

8. A method for producing a resistive igniter, comprising:
injection molding three or more portions of a ceramic element, wherein a first portion comprises a first material having a first resistivity, a second portion comprises a second material different than the first material and having a second resistivity, and a third portion comprises a third material different than the first and second material and having a third resistivity,
and removing air from the site where one or more of the first, second, and/or third materials are being deposited via injection molding.

9. The method of claim 8 further comprising applying one or more ceramic compositions to at least a portion of the ceramic element.

10. The method of claim 9 wherein a conductive ceramic composition is applied to the ceramic element.

11. The method of claim 9 wherein at least two distinct ceramic compositions having differing resistivities are applied to the ceramic element.

12. The method of claim 8 further comprising densifying the formed ceramic element.

13. The method of claim 8 wherein a portion of the igniter interior is removed.

14. The method of claim 8 wherein the ceramic element comprises regions of differing resistivity through a cross-section of the element.

15. The method of claim 1 or 8 wherein prior to and/or during injection molding of the second and/or third portion, air is removed from the site where the second and/or third material is being deposited to facilitate mating between the portions.

* * * * *